United States Patent [19]

Shah

[11] 4,001,369

[45] Jan. 4, 1977

[54] PROCESS FOR COSPINNING TRILOBAL FILAMENTS

[75] Inventor: Chandrakant Shantilal Shah, Seaford, Del.

[73] Assignee: E. I. Du Pont de Nemours and Company, Wilmington, Del.

[22] Filed: Mar. 4, 1976

[21] Appl. No.: 663,834

[52] U.S. Cl. ..... 264/177 F; 57/140 BY; 264/103; 428/397

[51] Int. Cl.[2] ..... B28B 21/54

[58] Field of Search ..... 264/177 F, 103; 57/140 BY; 428/397; 425/382, 464

[56] References Cited

UNITED STATES PATENTS

| | | | |
|---|---|---|---|
| 2,939,201 | 6/1960 | Holland | 264/177 F |
| 3,220,173 | 11/1965 | Pitzl | 264/177 F |
| 3,253,301 | 5/1966 | McGlaughlin | 264/177 F |

*Primary Examiner*—Jay H. Woo

[57] ABSTRACT

Improved process control for cospinning synthetic trilobal filaments having different modification ratios is provided by spinning filaments of one modification ratio through spinneret orifices consisting of three radially intersecting slots wherein each slot has parallel sides and spinning filaments of another modification ratio through spinneret orifices consisting of three radially intersecting slots which taper with increasing distance from the center of the orifice. The modification ratio of filaments spun from the orifices having tapered slots is less sensitive to changes in normal spinning process conditions than is the modification ratio of filaments spun from the orifices of slots having parallel sides. This differential response of filament modification ratio to spinning conditions provides better process control of the modification ratio differential between the filaments.

8 Claims, 2 Drawing Figures

PROCESS FOR COSPINNING TRILOBAL FILAMENTS

BACKGROUND OF THE INVENTION

1. Field of the Invention

This invention concerns a process for cospinning synthetic trilobal filaments having different trilobal modification ratios. More particularly, it concerns cospinning trilobal filaments from different spinneret orifice configurations.

2. Description of the Prior Art

Synthetic filaments having trilobal cross-sections and particular benefits associated therewith are described, for example, in U.S. Pat. Nos. 2,939,201 and 2,939,202. A characteristic of such filaments is their cross-section modification ratio, or MR. Certain benefits can be obtained from mixtures of such filaments or fibers having different modification ratios as described, for example, in U.S. Pat. No. 3,220,173. A convenient means of preparing such filament mixtures is to co-spin the different types in the desired ratio, and process the combined filaments through subsequent steps such as drawing, crimping, cutting into staple and so forth as a single, mixed-filament product. However, when filaments of two different modification ratios are co-spun from the same polymer, process adjustment to control the modification ratio of one filament independent of another is substantially impossible if the filaments are spun from the same type of spinneret orifice.

An object of this invention is to improve control over the modification ratio of filaments having different modification ratios under cospinning conditions from a common polymer supply.

SUMMARY OF THE INVENTION

According to this invention, control of differences between trilobal filament modification ratios when cospinning at least two filaments having different modification ratios is improved by spinning a filament of one modification ratio using a spinneret orifice configuration which is more sensitive to changes in normal processing conditions than is the orifice configuration used for the other filament having the different modification ratio.

The invention is in a process for cospinning at least two synthetic trilobal filaments from the same polymer composition wherein the undrawn filaments have a difference between their modification ratios of at least 0.3 MR units, the improvement, which provides spinning process control over the difference between the modification ratios, comprising spinning one filament from a spinneret orifice having a configuration comprised of three radially intersecting slots with each slot having parallel sides and spinning the other filament from a spinneret orifice having a configuration comprised of three radially intersecting tapered slots.

Preferably the tapered slots are tapered (with increasing distance from the orifice center) to define an angle of from about 3° to about 15° between imaginary lines which are extensions of the slot sides and measured at the point of intersection.

The process of this invention is particularly useful for cospinning filaments in the manufacture of crimped staple fibers for use in carpet yarn wherein filaments of one group have a modification ratio within the range of 1.6 to 1.9 and filaments of another group have a modification ratio within the range of 2.2 to 2.5.

BRIEF DESCRIPTION OF THE DRAWINGS

Referring to FIG. 1, symmetrical orifice 10 consists of three radially intersecting slots 12 whose imaginary center lines 13 intersect at center point 14. Each slot 12 has the same length 15 measured between center point 14 and the outermost edge of tip 18. Each tip 18 is in the shape of a circular enlargement having a diameter 19. Each slot 12 has the same constant width 16. Angle A between the center lines 13 of adjacent slots 12 is shown to be constant (120°).

In FIG. 2, symmetrical orifice 20 consists of three radially intersecting slots 22 whose imaginary center lines 23 intersect at center point 24. Each slot 22 has the same length 25 measured between center point 24 and flat tip 28 which is at right angles to center line 23. Each slot 22 is tapered such that base width 26 is greater than the width of tip 28 to define a taper angle B between imaginary extensions 29 of the sides of slot 22. Angle C between adjacent slots 22 is equal in each instance (120°).

Figure 1:
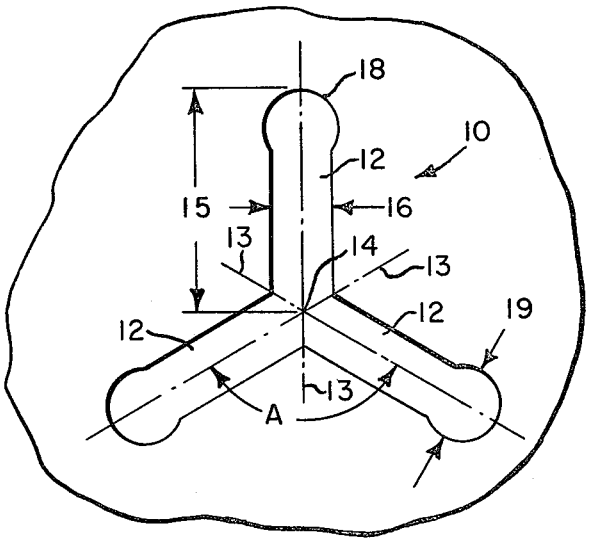
FIG. 1 represents a magnified spinneret orifice having a configuration comprised of three radially intersecting slots with each slot having parallel sides.
Figure 2:
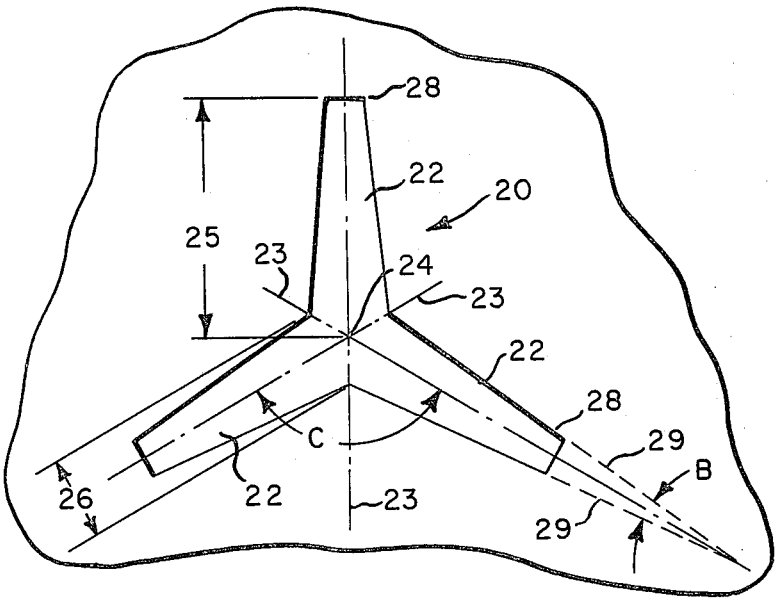
FIG. 2 represents a magnified spinneret orifice having a configuration comprised of three radially intersecting tapered slots.

Although the orifices of FIGS. 1 and 2 are shown to be symmetrical in each instance, for this invention symmetry is not required provided the specified shape conditions are met. For example, lengths 15 or 25 and angles A or C may differ among slots in the same orifice 10 or 20. The slot tips of both types of orifice for this invention may be squared, rounded, expanded or otherwise modified as known in the art without affecting their relative performance in this invention.

DESCRIPTION OF THE INVENTION

Spinneret orifices for spinning trilobal filaments having configurations comprised of three radially intersecting slots which radiate from a common point are known as described in U.S. Pat. Nos. 3,220,173; 3,746,827; 3,253,301 and 2,939,201. The modification ratios of filaments spun from such orifices are known to be affected not only by the orifice configuration and size but also by spinning conditions such as polymer relative viscosity, spinning temperature, and the quenching conditions used for solidifying the freshly spun filaments. When using a common polymer supply and identical spinning and quenching conditions (i.e. cospinning) to produce filaments having different modification ratios, any changes in processing conditions will have a similar effect upon the modification ratio for all the filaments when spinneret orifices having substantially the same configuration are used. In other words, it is substantially impossible to control or change the difference in modification ratio (ΔMR) by process adjustments under such conditions. By this invention added control is achieved by employing spinneret orifice configurations as described herein having differing sensitivity to changes in normal processing conditions.

Thus by this invention, when an undesired difference in modification ratio is detected, either because of spinneret design or because of a change in conditions during spinning, the spinning or quenching conditions may be adjusted to achieve the desired MR difference, since such changes will have little effect upon the filaments extruded through the orifices having tapered slots while the MR of filaments from the other orifices will be significantly affected. It is, of course, within the invention to use two or more different sized or shaped sets of each type of orifice.

"Modification ratio" (MR) and "trilobal filaments" as used herein are defined as described in U.S. Pat. No. 2,939,201.

The MR of each filament type is determined by measuring 10 filaments of the particular filament type and calculating the average. Considering method error and unavoidable fluctuations, a constant MR is assumed when none of the individual measurements differ from the average by more than ± 0.15 MR units.

"Relative viscosity" (RV) is the ratio of absolute viscosities at 25° C. of a polymer solution to its solvent. In the example, the solvent is formic acid/water (90/10 parts by weight) and the solution is prepared by dissolving 5.5 gm. of dried polymer in 50 ml./25° C. of the solvent. As employed herein, the "polymer" is always a sampling of freshly extruded filaments.

As used herein, the term "cospinning" applies not only to the situation of spinning the two types of filaments from the different types of orifices in the same spinneret, but also to where the different orifice configurations may be contained in separate spinnerets on the same spinning machine. In either case, the filaments of both types have a common polymer supply, are spun under substantially the same spinning conditions and are combined to give a mixed filament or fiber product.

Polymers supplied to the process of this invention may be any of those conventionally melt spun. Polyamides are preferred, including polyhexamethylene adipamide (66 nylon), polycaproamide (6 nylon), and their copolymers. Polyesters (e.g., polyethylene terephthalate), copolyesters, and polyalkylene polymers (e.g. polypropylene and its copolymers) are also advantageously employed.

EXAMPLE

Filaments are extruded from a supply of poly(hexamethylene adipamide) containing 0.5% by weight of poly(ethylene oxide) delusterant and a trace (less than or about 0.006% by weight) of very fine particles of titanium dioxide delusterant. Nominal RV for extruded polymer is about 70, but, as shown below, RV is varied over a range of 63 to 74.5 to test the effect on MR.

A full spinning machine is used for these tests. It has a single screw-melter for converting a supply of particulate polymer to a polymer melt. Relative viscosity is maintained at the desired level by controlling temperature and relative humidity of recirculating inert gas in the flake conditioner through which flake passes before being screw melted. The melt is then distributed to a plurality of spinning positions in each of which a portion of the melt undergoes final filtration and is extruded through a spinneret to form trilobal filaments. With one exception (see below), the melt temperature is maintained at 288° C. The extruded filaments are then quenched in chimneys using 7.2° C. air in cross flow at rates selected from the range of 290 to 350 standard cubic feet per minute (8.21 to 9.91 m.$^3$/min.). The quenched filaments from all of the spinning positions are then converged to tow. In a separate operation, the tow is drawn at a 3.75× draw ratio and crimped conventionally in a stuffer-box crimper. Finally the crimped tow is cut to carpet staple with an average length of 7.5 in. (19.0 cm.). Nominal denier of all the filaments is 18 dpf. (20 dtex).

Each spinneret has the same number of spinning orifices. Half of the spinnerets have orifices as shown in FIG. 1; the remaining half have the less sensitive orifices as shown in FIG. 2. The following measurements of MR are made on samples of undrawn filament of each type before either drawing, crimping or conversion to staple.

Trilobal filaments made by extrusion through the tapered orifices as shown in FIG. 2 [length 25 = 0.0170 in. (0.432 mm.); base width 26 = 0.0076 in. (0.193 mm.); tip width 28 = 0.0068 in. (0.173 mm.); taper angle B = 3.25 degrees; and depth of the parallel-walled capillary orifice = 0.008 in. (0.203 mm.)] yield MR values in the range 1.80–1.85 under "standard" conditions, i.e., 70 RV polymer, 350 ft.$^3$/min. (9.91 m.$^3$/min.) flow of quench air, and a given flow pattern of quench air through the quench chimney. In separate variations involving: (1) reduction of quench-air flow rate to 325 ft.$^3$/min. (9.20 m.$^3$/min.); (2) reduction of quench-air flow rate to 300 ft.$^3$/min. (8.50 m.$^3$/min.); (3) increasing the polymer melt temperature from 288° C. to 293° C.; and (4) altering the quench-air profile by blocking the top opening in the chimney door, MR values all remain in the range of 1.80–1.85. By raising the spinning pack as high as possible, thus delaying contact of freshly extruded filaments with the quench air, MR is reduced only to 1.75–1.80. Remarkable constancy of MR with adjustment of spinning variables is evident for these trilobal filaments.

The spinnerets with tapered trilobal orifices are replaced with different spinnerets having orifices also shaped as shown in FIG. 2 characterized by length 25 = 0.0140 in. (0.356 mm.), base width 26 = 0.0070 in. (0.178 mm.), tip width 28 = 0.0043 in. (0.109 mm.), taper angle B = 12.8 degrees, and a depth of the parallel-walled capillary orifice = 0.004 in. (0.102 mm.). This orifice is computed to yield about 1.65 MR at the "standard" conditions. Using "standard" conditions except as indicated in the following table, the MR values obtained are:

| RV range | Quench Air Flow Rate 290 ft$^3$/min (8.22 m$^3$/min) | 320 ft$^3$/min (9.06 m$^3$/min) | 350 ft$^3$/min (9.91 m$^3$/min) | 380 ft$^3$/min (10.76 m$^3$/min) |
|---|---|---|---|---|
| 74 | 1.73 | 1.71 | 1.78 | 1.77 |
| 69–71 | 1.63 | 1.65 | 1.68 | 1.67 |
| 63–64 | 1.68 | 1.67 | 1.66 | 1.69 |

As seen from the above, the maximum difference in MR obtained while varying RV by 10 units and quench rate by 90 ft.$^3$/min. (2.55 m.$^3$/min.) is only 0.15 units which, considering method error and scatter of the results, is almost constant. In other words, the MR of a filament from this type of orifice is not sensitive to changes in polymer RV under normal operating conditions.

The more sensitive FIG. 1 orifices used for the other spinnerets are designed to provide an MR of 2.3 ± 0.15 at "standard" conditions. They have a length 15 = 0.0183 in. (0.465 mm.), constant width 16 = 0.0057 in. (0.145 mm.), tip diameter 19 = 0.0076 in. (0.193 mm.), and depth = 0.008 in. (0.203 mm.). Varying only RV, the following MR values are obtained for trilobal filaments from these orifices:

| RV increased | | MR increased | |
|---|---|---|---|
| from | to | from | to |
| 69 | 71 | 2.10 | 2.24 |
| 71 | 73 | 2.25 | 2.45 |
| 73 | 74.5 | 2.46 | 2.65 |

Thus with these orifices an increase in RV of 5.5 (69 to 74.5) increases the filament MR by 0.55 units, as compared to an increase of only 0.10 MR units for a 5 RV increase (1.78 vs. 1.68 MR; 69–74 RV at "standard" quench) shown in the previous table for the tapered orifices. A change of 0.55 MR units is clearly detectable in carpets made of yarns comprised of these filaments.

Thus, for example, by changing polymer RV the difference in MR between filaments being cospun from these two different orifices can be changed and controlled as desired by this invention.

While this example shows the less sensitive orifices being used for the lower MR filaments and the more sensitive orifices for the higher MR filaments, the reverse is equally applicable. Moreover, the invention is applicable to the production of 3 or more types of filaments differing in MR.

What is claimed is:

1. In a process for cospinning at least two synthetic trilobal filaments from the same polymer composition wherein the undrawn filaments have a difference between their modification ratios of at least 0.3 MR units, the improvement comprising spinning one filament from a spinneret orifice having a configuration comprised of three radially intersecting slots with each slot having parallel sides and spinning the other filament from a spinneret orifice having a configuration comprised of three radially intersecting tapered slots.

2. The process of claim 1 wherein the tapered slots have a taper angle of from about 3° to about 15°.

3. The process of claim 2 wherein the modification ratio of one filament is from about 1.6 to about 1.9 and the modification ratio for the other filament is from about 2.2 to 2.5.

4. The process of claim 3 wherein the filament having the lower modification ratio is spun from the orifice comprised of tapered slots.

5. The process of claim 3 wherein the filament having the higher modification ratio is spun from the orifice comprised of tapered slots.

6. The process of claim 3 wherein the polymer composition comprises a synthetic polyamide melt.

7. The process of claim 6 wherein the polyamide is poly(hexamethylene adipamide).

8. The process of claim 7 wherein the poly(hexamethylene adipamide) contains poly(ethylene oxide) delusterant.

* * * * *